US006175707B1

(12) United States Patent
Eklund et al.

(10) Patent No.: US 6,175,707 B1
(45) Date of Patent: Jan. 16, 2001

(54) INTEGRATED TONER TRANSPORT/TONER CHARGING DEVICE

(75) Inventors: Elliott A. Eklund, Penfield; Yelena Shapiro, Rochester; Jack T. Lestrange, Rochester; Michael D. Thompson, Rochester, all of NY (US); Tuan Anh Vo, Hawthorne; Kaiser H. Wong, Torrance, both of CA (US)

(73) Assignee: Xerox Corporation, Stamford, CT (US)

( * ) Notice: Under 35 U.S.C. 154(b), the term of this patent shall be extended for 0 days.

(21) Appl. No.: 09/451,237

(22) Filed: Nov. 29, 1999

Related U.S. Application Data

(63) Continuation-in-part of application No. 09/313,313, filed on May 17, 1999.

(51) Int. Cl.[7] ..... G03G 15/08
(52) U.S. Cl. ..... 399/265; 399/266; 399/292
(58) Field of Search ..... 399/265, 266, 399/289, 290, 291, 292, 293, 53, 55

(56) References Cited

U.S. PATENT DOCUMENTS 4,647,179 3/1987 Schmidlin ..... 355/3 DD
4,777,106 10/1988 Fotland et al. ..... 430/120
5,532,100 7/1996 Christy et al. ..... 430/120
5,717,986 * 2/1998 Vo et al. ..... 399/261

* cited by examiner

*Primary Examiner*—Arthur T. Grimley
*Assistant Examiner*—Huan Tran
(74) *Attorney, Agent, or Firm*—Lloyd F. Bean, II

(57) ABSTRACT

An apparatus for developing a latent image recorded on an imaging surface, including a housing defining a chamber for storing a supply of developer material including toner; a dispensing system for dispensing toner of a first color and toner of a second color into said housing; an air system for fuildizing and mixing toner of said first color and toner of said second color; a donor member, spaced from the imaging surface, for transporting toner on the surface thereof to a region opposed from the imaging surface, said donor member includes an electrode array on the outer surface thereof, said array including a plurality of spaced apart electrodes extending substantial across width of the surface of the donor member; and a multi-phase voltage source operatively coupled to said electrode array, the phase being shifted with respect to each other such as to create an electrodynamic wave pattern for moving toner particles to and from a development zone.

12 Claims, 5 Drawing Sheets

INTEGRATED TONER TRANSPORT/TONER CHARGING DEVICE

INCORPORATION BY REFERENCE

This application is continuation in part of patent application Ser. No. 09/313,313, filed May 17, 1999. The following is specifically incorporated by reference co-pending patent application Ser. No., 09/312,873, and Ser. No., 09/312/872, entitled "A MULTIZONE METHOD FOR XEROGRAPHIC POWDER DEVELOPMENT: VOLTAGE SIGNAL APPROACH", and "A METHOD FOR LOADING DRY XEROGRAPHIC TONER ONTO A TRAVELING WAVE GRID", respectively.

This invention relates generally to a development apparatus for ionographic or electrophotographic imaging and printing apparatuses and machines, and more particularly is directed to an apparatus and method for loading dry Xerographic toner onto a traveling wave grid, charging toner and developing a latent electrostatic image.

BACKGROUND OF THE INVENTION

Generally, the process of electrophotographic printing includes charging a photoconductive member to a substantially uniform potential so as to sensitize the surface thereof. The charged portion of the photoconductive surface is exposed to a light image from either a scanning laser bean or an original document being reproduced. This records an electrostatic latent image on the photoconductive surface. After the electrostatic latent image is recorded on the photoconductive surface, the latent image is developed. Two component and single component developer materials are commonly used for development. A typical two component developer comprises magnetic carrier granules having toner particles adhering triboelectrically thereto. A single component developer material typically comprises toner particles. Toner particles are attracted to the latent image forming a toner powder image on the photoconductive surface, the toner powder image is subsequently transferred to a copy sheet, and finally, the toner powder image is heated to permanently fuse it to the copy sheet in image configuration.

The electrophotographic marking process given above can be modified to produce color images. One color electrophotographic marking process, called image on image processing, superimposes toner powder images of different color toners onto the photoreceptor prior to the transfer of the composite toner powder image onto the substrate. While image on image process is beneficial, it has several problems. For example, when recharging the photoreceptor in preparation for creating another color toner powder image it is important to level the voltages between the previously toned and the untoned areas of the photoreceptor.

In the application of the toner to the latent electrostatic images contained on the charge-retentive surface, it is necessary to transport the toner from a developer housing to the surface. A basic limitation of conventional xerographic development systems, including both magnetic brush and single component, is the inability to deliver toner (i.e. charged pigment) to the latent images without creating large adhesive forces between the toner and the conveyor, which transport the toner to latent images. As will be appreciated, large fluctuation (i.e. noise) in the adhesive forces that cause the pigment to tenaciously adhere to the carrier severely limit the sensitivity of the developer system thereby necessitating higher contrast voltages forming the images. Accordingly, it is desirable to reduce such noise particularly in connection with latent images formed by contrasting voltages.

In order to minimize the creation of such fluctuation in adhesive forces, there is provided, in the preferred embodiment of the invention a toner conveyor including means for generating traveling electrostatic waves which can move the toner about the surface of the conveyor with minimal contact therewith.

Traveling waves have been employed for transporting toner particles in a development system, for example U.S. Pat. No. 4,647,179 to Schmidlin, which is hereby incorporated by reference. In that patent, the traveling wave is generated by alternating voltages of three or more phases applied to a linear array of conductors placed abut the outer periphery of the conveyor. The force F for moving the toner about the conveyor is equal QE t where Q is the charge on the toner and E t is the tangential field supplied by a multi-phase AC voltage applied to the array of conductors.

In that Patent, toner is presented to the conveyor by means of a magnetic brush, which is rotated in the same direction as the traveling wave. This gives an initial velocity to the toner particles, which enables toner having a much lower charge to be propelled by the wave. Typical approaches in the past have used a magnetic brush to load toner to the traveling wave grid. These approaches will mechanically wear the traveling wave device at the loading zone (grinding at a stationary loading zone on the grid). These approaches are also limited in the amount of toner they expose to stripping because the magnetic brush tips tend to be sparse for large brush spacing and the stripping field on the traveling wave grid decreases exponentially with distance from the grid surface. The methods to increase the amount of toner loaded to the grid (with the magnetic brush in this mode) include speeding up the magnetic roll, decreasing the spacing, increasing the loading zone length, and increasing the number of rolls. These methods all will result in increased wear on the grid.

Fluidized beds have been used to provide a means for storing, mixing and transporting toner in certain single component development systems and loading onto developer rolls. Efficient means for fluidizing toner and charging the particles within the fluidized bed are disclosed in U.S. Pat. No. 4,777,106 and U.S. Pat. No. 5,532,100, which are hereby incorporated by reference. In these disclosures, corona devices are embedded in the fluidized toner for simultaneous toner charging and deposition onto a receiver roll. While the development system as described has been found satisfactory in some development applications, it leaves something to be desired in the way in applications requiring the blending of two or more dry powder toners to achieve custom color development. Also, it has been found in the above systems that there are frequently disturbances to the flow in the fluidized bed associated with charged particles in the high electric fields surrounding corona devices immersed in the reservoir. Also, wire contamination present a reliability issue.

Triboelectric charging (contact electrification) of dry toners is a standard method used to electrically charge toner particles for development of latent electrostatic images. An alternate method to charge toners is via ion bombardment (Ion Charging) which offers many advantages, especially in applications to custom color where "in-situ" toner mixing is advantageous.

Triboelectric charging of colored toners requires different additives dependent on toner color to achieve stable charging whereas ion charging of toners offers the advantage of charging toner particles based mainly on their size, independent of their intrinsic composition and surface structure.

Triboelectric charging of toners also can create localized patches of charge on the toner particles which can lead to strong adhesion of these toners to various surfaces requiring special measures to remove them in the development, transfer and cleaning steps in the xerographic process. In the ion charging process, charged ions bombarding the toner particles are driven by the net field around the particles which tends to uniformly charge the toner, helping to decrease adhesion of these toners to donor or photoreceptor surfaces. One method to charge toner via ion bombardment involves fluidizing the toner and charging it using corona generation in close proximity to this fluidized bed.

Typical approaches in the past have used a magnetic brush to load toner to the traveling wave grid. These approaches will mechanically wear the traveling wave device at the loading zone (grinding at a stationary loading zone on the grid).

These approaches are also limited in the amount of toner they expose to stripping because the magnetic brush tips tend to be sparse for large brush spacing and the stripping field on the traveling wave grid decreases exponentially with distance from the grid surface. The methods to increase the amount of toner loaded to the grid (with the magnetic brush in this mode) include speeding up the magnetic roll, decreasing the spacing, increasing the loading zone length, and increasing the number of rolls. These methods all will result in increased wear on the grid.

At the development zone there are a number of issues which need to be addressed. When toner is presented to a latent electrostatic image in the development zone it is necessary to control the toner cloud height and speed at the entrance to the development zone. High quality development requires that the toner cloud be in a state which will enable it to be captured by fine details of the latent electrostatic image, the field lines of which are very local to the imaging surface. Toner transporting at too high a velocity or too close to the transport grid will not be developed to the image. The way we accomplish high quality development for mechanical donor roll powder cloud systems is to apply an AC field between the donor and the photoreceptor backplane to move the toner cloud closer to the image (donor AC).

However, noting the issues above the achievement of high reliability and simple, economic manufacturability of the system continue to present problems.

SUMMARY OF THE INVENTION

There is provided an apparatus for developing a latent image recorded on an imaging surface, including a housing defining a chamber for storing a supply of developer material including toner; a dispensing system for dispensing toner of a first color and toner of a second color into said housing; an air system for fuildizing and mixing toner of said first color and toner of said second color; a donor member, spaced from the imaging surface, for transporting toner on the surface thereof to a region opposed from the imaging surface, said donor member includes an electrode array on the outer surface thereof, said array including a plurality of spaced apart electrodes extending substantial across width of the surface of the donor member; and a multi-phase voltage source operatively coupled to said electrode array, the phase being shifted with respect to each other such as to create an electrodynamic wave pattern for moving toner particles to and from a development zone.

DETAILED DESCRIPTION OF THE INVENTION

Inasmuch as the art of electrophotographic printing is well known, the various processing stations employed in the printing machine will be shown hereinafter schematically and their operation described briefly with reference thereto.

Figure 1:
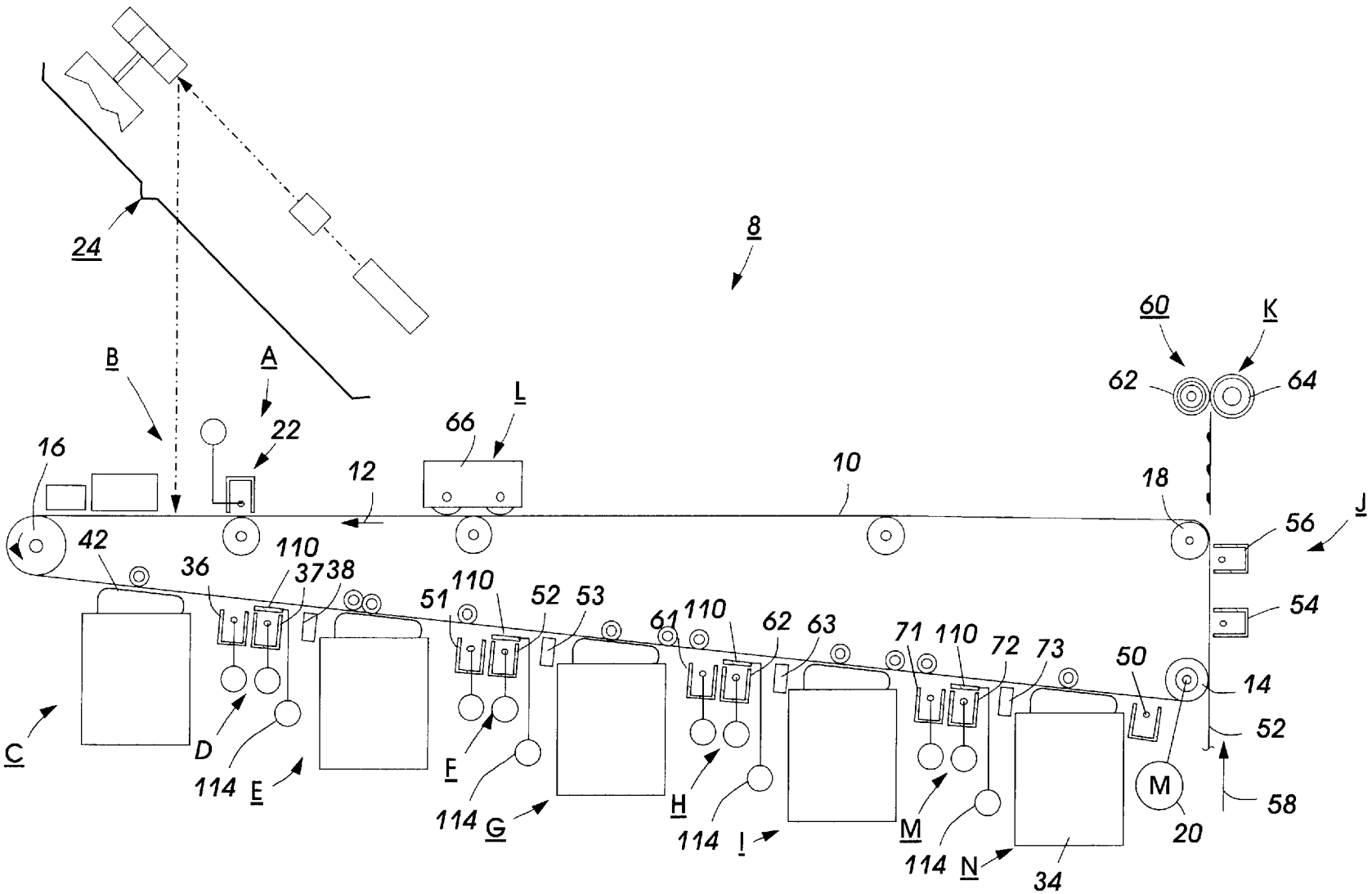
FIG. 1 is a schematic elevational view of an illustrative electrophotographic printing or imaging machine or apparatus incorporating a development apparatus having the features of the present invention therein.

Referring initially to FIG. 1, there is shown an illustrative electrophotographic machine having incorporated therein the development apparatus of the present invention. An electrophotographic printing machine creates a color image in a single pass through the machine and incorporates the features of the present invention. The printing machine uses a charge retentive surface in the form of an Active Matrix (AMAT) photoreceptor belt 10 which travels sequentially through various process stations in the direction indicated by the arrow 12. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations. For convenience, a single section of the photoreceptor belt, referred to as the image area, is identified. The image area is that part of the photoreceptor belt which is to receive the toner powder images which, after being transferred to a substrate, produce the final image. While the photoreceptor belt may have numerous image areas, since each image area is processed in the same way, a description of the typical processing of one image area suffices to fully explain the operation of the printing machine.

Figure 2:
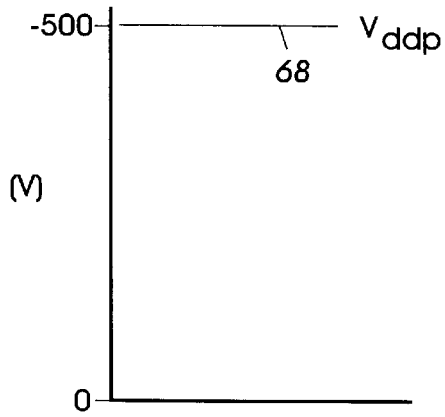
FIG. 2 shows a typical voltage profile of an image area in the electrophotographic printing machines illustrated in FIG. 1 after that image area has been charged.

As the photoreceptor belt 10 moves, the image area passes through a charging station A. At charging station A, a corona generating device, indicated generally by the reference numeral 22, charges the image area to a relatively high and substantially uniform potential. FIG. 2 illustrates a typical voltage profile 68 of an image area after that image area has left the charging station A. As shown, the image area has a uniform potential of about −500 volts. In practice, this is accomplished by charging the image area slightly more negative than −500 volts so that any resulting dark decay reduces the voltage to the desired −500 volts. While FIG. 2 shows the image area as being negatively charged, it could be positively charged if the charge levels and polarities of the toners, recharging devices, photoreceptor, and other relevant regions or devices are appropriately changed.

After passing through the charging station A, the now charged image area passes through a first exposure station B.

Figure 3:
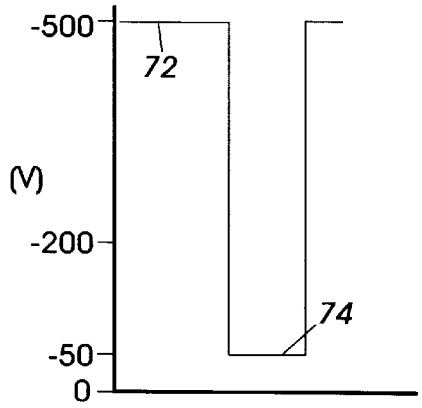
FIG. 3 shows a typical voltage profile of the image area after being exposed.
Figure 4:
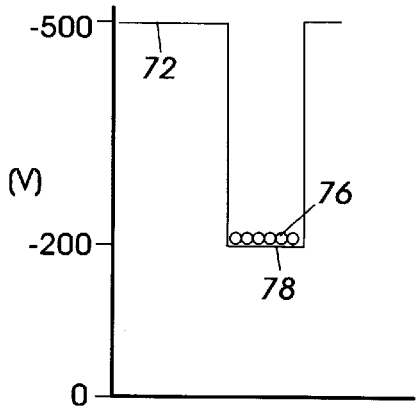
FIG. 4 shows a typical voltage profile of the image area after being developed.

At exposure station B, the charged image area is exposed to light which illuminates the image area with a light representation of a first color (say black) image. That light representation discharges some parts of the image area so as to create an electrostatic latent image. While the illustrated embodiment uses a laser based output scanning device 24 as a light source, it is to be understood that other light sources, for example an LED printbar, can also be used with the principles of the present invention. FIG. 3 shows typical voltage levels, the levels 72 and 74, which might exist on the image area after exposure. The voltage level 72, about −500 volts, exists on those parts of the image area, which were not illuminated, while the voltage level 74, about −50 volts, exists on those parts which were illuminated. Thus after exposure, the image area has a voltage profile comprised of relative high and low voltages.

After passing through the first exposure station B, the now exposed image area passes through a first development station C that is identical in structure with development system E, G, and I. The first development station C deposits a first color, say black, of negatively charged toner 76 onto the image area. That toner is attracted to the less negative sections of the image area and repelled by the more negative sections. The result is a first toner powder image on the image area.

Figure 9:
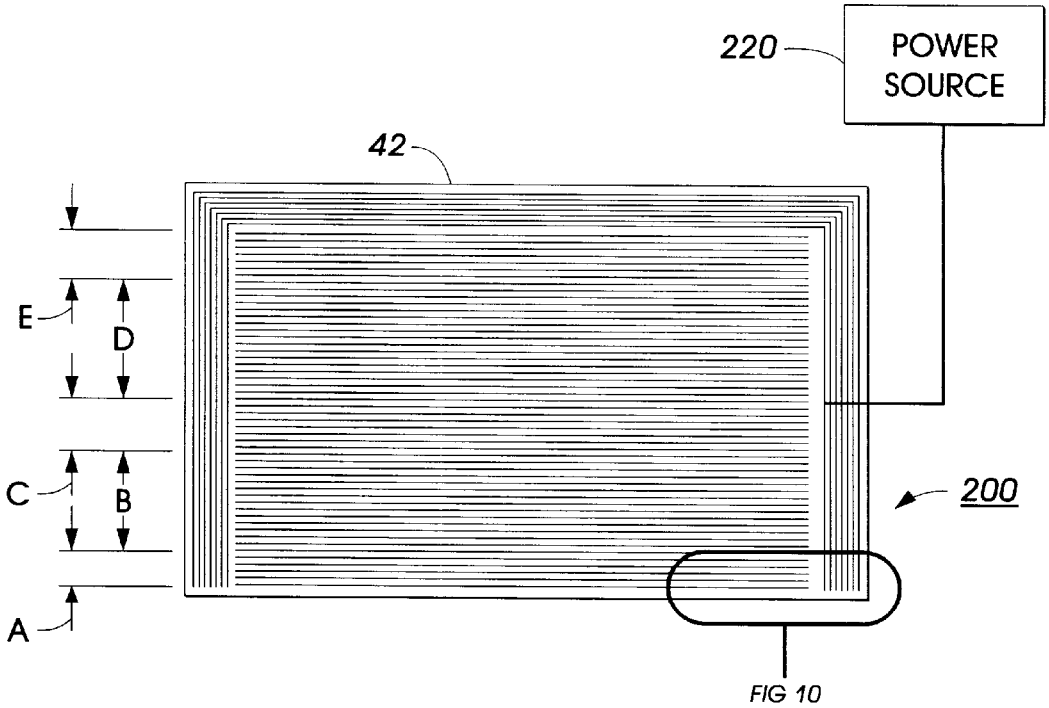
FIGS. 9 and 10 are top view of a portion of the flexible donor belt of the present invention.
Figure 10:
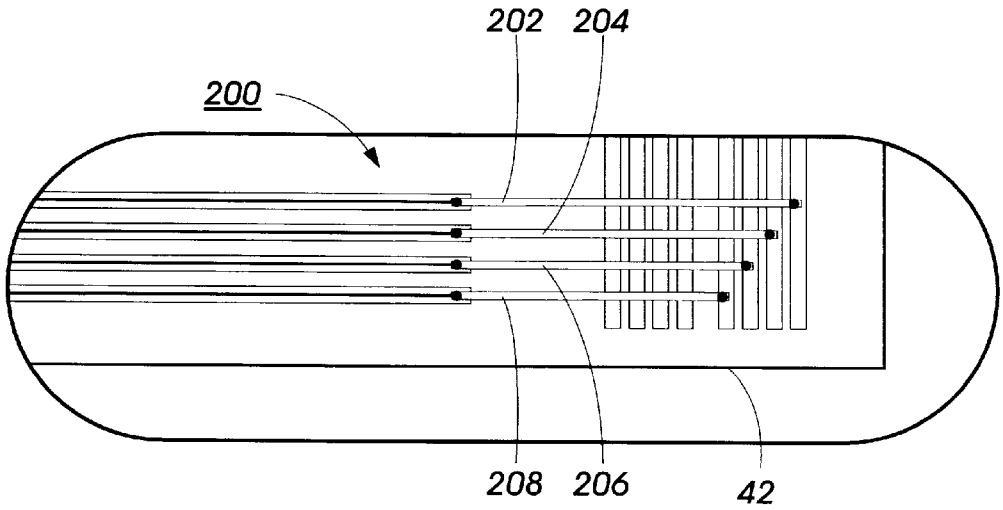

For the first development station C, development system 34 includes a flexible donor belt 42 having groups of electrode arrays near the surface of the belt. As illustrated in FIGS. 9–10, Electrode array 200 has group areas A–F in which each group area is individually addressable to perform the function of: Loading; Transferring; Developing; Transferring and Unloading. Each electrode array group area is independently addressable and operatively connected to voltage source 220 in order to supply a voltage in the order of 0–1000 volts AC or DC to each group area. The electrodes in array group area A picks up the toner from the developer bed 76 in FIG. 8 and transports it via the electrostatic wave set up by power trace (see FIG. 12). Electrode array group areas B and D connected to the voltage source via phase shifting circuitry (see FIG. 12) such that a traveling wave pattern is established. The electrostatic field forming the traveling wave pattern pushes the charged toner particles about the surface of the donor belt from the developer sump 76 to the belt 10 where they are transferred to the latent electrostatic images on the belt by electrode group area C. Thereafter, toner is moved by electrode array group area D where electrode group area E is biased to unload remaining toner off the belt.

FIG. 3 shows the voltages on the image area after the image area passes through the first development station C. Toner 76 (which generally represents any color of toner) adheres to the illuminated image area. This causes the voltage in the illuminated area to increase to, for example, about −200 volts, as represented by the solid line 78. The unilluminated parts of the image area remain at about the level 72.

After passing through the first development station C, the now exposed and toned image area passes to a first recharging station D. The recharging station D is comprised of two corona recharging devices, a first recharging device 36 and a second recharging device 37, which act together to recharge the voltage levels of both the toned and untoned parts of the image area to a substantially uniform level. It is to be understood that power supplies are coupled to the first and second recharging devices 36 and 37, and to any grid or other voltage control surface associated therewith, as required so that the necessary electrical inputs are available for the recharging devices to accomplish their task.

Figure 5:
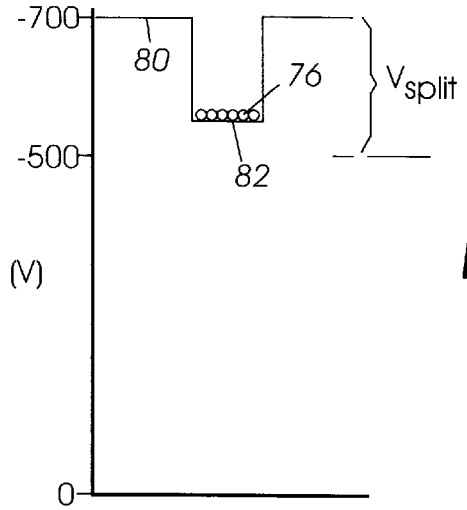
FIG. 5 shows a typical voltage profile of the image area after being recharged by a first recharging device.

FIG. 5 shows the voltages on the image area after it passes through the first recharging device 36. The first recharging device overcharges the image area to more negative levels than that which the image area is to have when it leaves the recharging station D. For example, as shown in FIG. 5 the toned and the untoned parts of the image area, reach a voltage level 80 of about −700 volts. The first recharging device 36 is preferably a DC scorotron.

Figure 6:
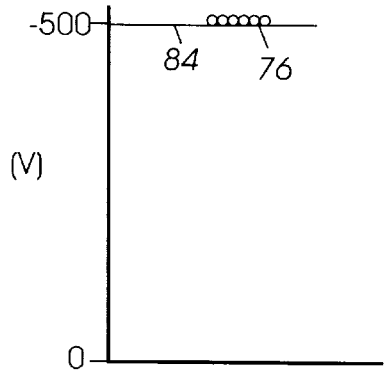
FIG. 6 shows a typical voltage profile of the image area after being recharged by a second recharging device.

After being recharged by the first recharging device 36, the image area passes to the second recharging device 37. Referring now to FIG. 6, the second recharging device 37 reduces the voltage of the image area, both the untoned parts and the toned parts (represented by toner 76) to a level 84 which is the desired potential of −500 volts.

Figure 7:
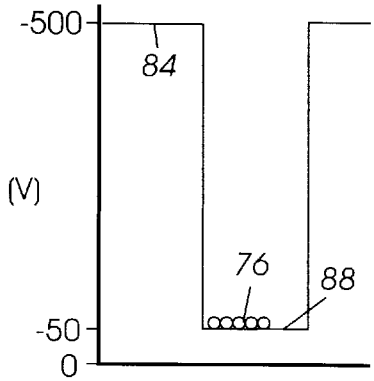
FIG. 7 shows a typical voltage profile of the image area after being exposed for a second time.

After being recharged at the first recharging station D, the now substantially uniformly charged image area with its first toner powder image passes to a second exposure station 38. Except for the fact that the second exposure station illuminates the image area with a light representation of a second color image (say yellow) to create a second electrostatic latent image, the second exposure station 38 is the same as the first exposure station B. FIG. 7 illustrates the potentials on the image area after it passes through the second exposure station. As shown, the non-illuminated areas have a potential about −500 as denoted by the level 84. However, illuminated areas, both the previously toned areas denoted by the toner 76 and the untoned areas are discharged to about −50 volts as denoted by the level 88.

The image area then passes to a second development station E. Except for the fact that the second development station E contains a toner which is of a different color (yellow) than the toner (black) in the first development station C, the second development station is beneficially the same as the first development station. Since the toner is attracted to the less negative parts of the image area and repelled by the more negative parts, after passing through the second development station E the image area has first and second toner powder images which may overlap.

The image area then passes to a second recharging station F. The second recharging station F has first and second recharging devices, the devices 51 and 52, respectively, which operate similar to the recharging devices 36 and 37. Briefly, the first corona recharge device 51 overcharges the image areas to a greater absolute potential than that ultimately desired (say −700 volts) and the second corona recharging device, comprised of coronodes having AC potentials, neutralizes that potential to that ultimately desired.

The now recharged image area then passes through a third exposure station 53. Except for the fact that the third exposure station illuminates the image area with a light representation of a third color image (say magenta) so as to create a third electrostatic latent image, the third exposure station 38 is the same as the first and second exposure stations B and 38. The third electrostatic latent image is then developed using a third color of toner (magenta) contained in a third development station G.

The now recharged image area then passes through a third recharging station H. The third recharging station includes a pair of corona recharge devices 61 and 62 which adjust the voltage level of both the toned and untoned parts of the image area to a substantially uniform level in a manner similar to the corona recharging devices 36 and 37 and recharging devices 51 and 52.

After passing through the third recharging station the now recharged image area then passes through a fourth exposure station 63. Except for the fact that the fourth exposure station illuminates the image area with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner (cyan) contained in a fourth development station 1.

Optionally, the image area is recharged by and recharging devices 71 and 72. After passing through the third recharging station the now recharged image area then passes through a fourth exposure station 73. Except for the fact that the fifth exposure station illuminates the image area with a light representation of a custom color image (say mixture of green, blue and red) so as to create a fifth electrostatic latent image, the fifth exposure station 73 is the same as the first, second, and third exposure stations, the exposure stations B, 38, and 53, respectively. The fifth electrostatic latent image is then developed using a custom color toner contained in a fourth development station J.

To condition the toner for effective transfer to a substrate, the image area then passes to a pretransfer corotron member 50 which delivers corona charge to ensure that the toner particles are of the required charge level so as to ensure proper subsequent transfer.

After passing the corotron member 50, the four toner powder images are transferred from the image area onto a support sheet 52 at transfer station J. It is to be understood that the support sheet is advanced to the transfer station in the direction 58 by a conventional sheet feeding apparatus, which is not shown. The transfer station J includes a transfer corona device 54, which sprays positive ions onto the backside of sheet 52. This causes the negatively charged toner powder images to move onto the support sheet 52. The transfer station J also includes a detack corona device 56 which facilitates the removal of the support sheet 52 from the printing machine 8.

After transfer, the support sheet 52 moves onto a conveyor (not shown) which advances that sheet to a fusing station K. The fusing station K includes a fuser assembly, indicated generally by the reference numeral 60, which permanently affixes the transferred powder image to the support sheet 52. Preferably, the fuser assembly 60 includes a heated fuser roller 62 and a backup or pressure roller 64. When the support sheet 52 passes between the fuser roller 62 and the backup roller 64 the toner powder is permanently affixed to the sheet support 52. After fusing, a chute, not shown, guides the support sheets 52 to a catch tray, also not shown, for removal by an operator.

After the support sheet 52 has separated from the photoreceptor belt 10, residual toner particles on the image area are removed at cleaning station L via a cleaning brush contained in a housing 66. The image area is then ready to begin a new marking cycle.

The various machine functions described above are generally managed and regulated by a controller which provides electrical command signals for controlling the operations described above.

Figure 8:
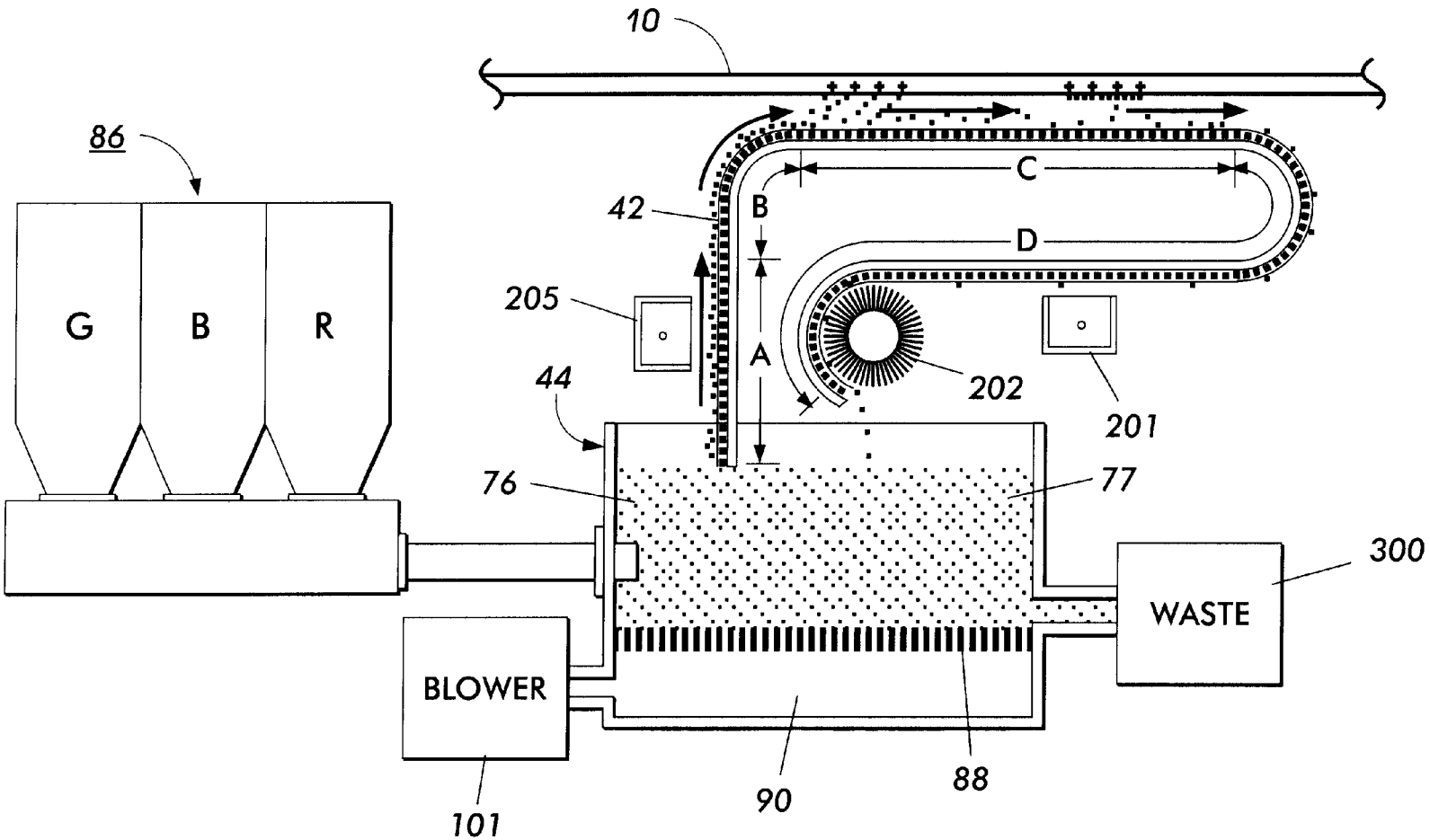
FIG. 8 is a schematic elevational view showing the development apparatus used in the FIG. 1 printing machine.

Turning to FIG. 8, which illustrates the development system 34 in greater detail, development system 34 includes a housing 44 defining a chamber 76 for storing a supply of developer material therein. Donor belts 42 comprise a flexible circuit broad having finely spaced electrode array 200 thereon as shown in FIGS. 9 and 10. The electrode array 200 has a four phase grid structure consisting of electrodes 202, 204, 206 and 208 having a voltage source operatively connected thereto in the manner shown in order to supply AC or DC voltage in the appropriate electrode area groups A–F.

A primary obstacle to custom color with dry powder Xerography has been the charging and delivery of toner mixtures. The charging step is actually a two part problem, consisting of physical mixing of two or more toners and charging of this blend such that each component color acquires roughly the same particle charge. For (both single and two component) development systems which rely on triboelectricity to charge insulating toner particles, problems arise due to the strong dependence of triboelectric charging on the pigment in the toner. The fact that different color toners acquire very different amounts of triboelectric charge, or charge against one another to produce oppositely charged particles, makes it difficult to construct development systems in which tribo-charged toners can be blended reliably and reproducibly. A final problem is the uniform delivery of the charged blend to a development zone at the desired development rate. In order to be competitive, a development system must be able to approach or exceed the uniformity and productivity of offset printing.

The development system of the present invention overcomes these difficulties. A fluidized bed is used as a combination toner storage and mixing reservoir. Toner is charged by exposure to a corona source a process to provide particle charging independent of the pigment in the toner. Finally, a traveling wave toner conveyor is used to move the toner through the development system using electrical forces only.

The fluidized bed provides the ideal mixing reservoir, allowing the quick and complete blending of two or more toners. The fluidized bed 77 consists of two chambers separated by a porous plate 88, which allows the passage of air but not toner. Toner is dispensed from toner dispenser 86 which dispenses three different colored toners (e.g. green, blue, red) in amounts require to produce the desired custom color from the mixture of one or more toners. (note : toner dispenser for development station C, E, G, I contain a dispenser for dispensing one color type of toner) The lower chamber 90, the air plenum, is pressurized with gas (air) supplied by blower 101 which passes through the porous plate 88 to fluidize the toner contained in the upper chamber. Initial experiments showed that mixtures of two different color toners are thoroughly blended within one minute.

Pick up of the toner from the fluidized bed and subsequent transport to the charging and development zones is accomplished by traveling wave grid 42. Applicants have found that nominally uncharged toner can be loaded from the fluidized bed and transported with the traveling wave conveyor. (Note that individual toner particles may possess some small amount of positive or negative charge, but a collection of particles will have a charge distribution centered about zero.) The traveling wave grid used for these experiments had 75 $\mu$m wide electrodes, separated by 75 $\mu$m. It has been possible to move toner both on grids overcoated with an electrically relaxable polymer layer and on bare grids with no overcoat.

The amount of toner loaded and its transport speed can be controlled by adjusting the air flow (to control the state of the toner in the fluidized bed), the amplitude and frequency of the electrical signals applied to the traveling wave grid, and the pulse shape used. It is possible to move toner with both sinusoidal and square pulses. The optimum orientation for toner loading is in the vertical position, as shown in FIG. 8. Results from preliminary experiments have shown transport speeds of approximately 5 in/sec. The toner blend formed on the grid 42 is first moved in the vicinity of a charging device 205 (e.g. AC scorotron) to boost its charge to a level suitable for development, and then transported to a development zone where the toner image-wise develops an electrostatic latent image.

Results from recent charging experiments have shown that it is possible to controllably adjust the average Q/M of the toner from below −10 $\mu$C/g to above −30 $\mu$C/g, by adjusting the toner layer thickness, charging device output and charging dwell time. In addition to pigment independent toner charge, corona charging of toner has the additional benefit of producing toner with low electrostatic adhesion, many times lower than that for triboelectrically charged toner. This enables higher development efficiencies and potentially higher toner delivery rates.

After development, residual toner is moved from the development zone to another corona device 201 to neutralize the toner before returning it to the fluidized bed reservoir. Complete removal of residual toner is accomplished by a combination of electrical forces from the grid and mechanical forces from a cleaning brush 202. The neutralization step is necessary to maintain a constant toner charge level in the reservoir which, in turn, helps to keep the toner loading conditions constant.

If a new mixture of a custom color is desired, waste system 300 clears chamber 76 of previous custom toner mixture. Waste system 300 clears toner with use of a vacuum while the toner is being fluidized.

Other embodiments and modifications of the present invention may occur to those skilled in the art subsequent to a review of the information presented herein; these embodiments and modifications, as well as equivalents thereof, are also included within the scope of this invention.

What is claimed is:

1. An apparatus for developing a latent image recorded on an imaging surface, comprising:

a housing defining a chamber for storing a supply of developer material comprising toner;

a dispensing system for dispensing toner of a first color and toner of a second color into said housing;

an air system for fluidizing and mixing toner of said first color and toner of said second color;

a donor member, spaced from the imaging surface, for transporting toner on an outer surface of said donor member to a region opposed from the imaging surface, said donor member includes an electrode array on the outer surface thereof, said array including a plurality of spaced apart electrodes extending substantial across width of the surface of the donor member; and a multi-phase voltage source operatively coupled to said electrode array, the phase being shifted with respect to each other such as to create an electrodynamic wave pattern for moving toner particles to and from a development zone.

2. The apparatus of claim 1, further comprising means for clearing toner from said housing.

3. The apparatus of claim 1, further comprising a charging device for charging toner on the surface of said donor member.

4. The apparatus of claim 3, wherein said charging device is disposed adjacent to the outer surface of said donor member.

5. A method for developing a latent image recorded on an imaging surface, comprising the steps of:

dispensing toner of a first color and toner of a second color into a housing;

fluidizing and mixing toner of said first color and toner of said second color; and transporting toner along the outer surface of said donor member with an electrodynamic wave pattern.

6. The method of claim 5, further comprising the step of clearing toner from said housing for subsequent dispensing.

7. The method of claim 5, further comprising the step of charging the toner with a charging device while the toner is being transported along the surface of the donor member.

8. The method of claim 5, further comprising the step of developing the latent image with toner.

9. A printing machine having an apparatus for developing a latent image recorded on an imaging surface, comprising:

a housing defining a chamber for storing a supply of developer material comprising toner;

a dispensing system for dispensing toner of a first color and toner of a second color into said housing;

an air system for fluidizing and mixing toner of said first color and toner of said second color;

a donor member, spaced from the imaging surface, for transporting toner on an outer surface of said donor member to a region opposed from the imaging surface, said donor member includes an electrode array on the outer surface thereof, said array including a plurality of spaced apart electrodes extending substantial across width of the surface of the donor member; and a multi-phase voltage source operatively coupled to said electrode array, the phase being shifted with respect to each other such as to create an electrodynamic wave pattern for moving toner particles to and from a development zone.

10. The apparatus of claim 9, further comprising means for clearing toner from said housing.

11. The apparatus of claim 10, further comprising a charging device for charging toner on the surface of said donor member.

12. The apparatus of claim 11, wherein said charging device is disposed adjacent to the outer surface of said donor member.

* * * * *